US007556080B2

(12) United States Patent
Nien

(10) Patent No.: US 7,556,080 B2
(45) Date of Patent: Jul. 7, 2009

(54) BLIND AND ITS ASSEMBLING METHOD

(75) Inventor: Ming Nien, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 325 days.

(21) Appl. No.: 11/668,487

(22) Filed: Jan. 30, 2007

(65) Prior Publication Data

US 2008/0179019 A1 Jul. 31, 2008

(51) Int. Cl.
*E06B 9/30* (2006.01)

(52) U.S. Cl. ..... 160/168.1 R; 160/178.3

(58) Field of Classification Search ..... 160/170, 160/171, 168.1 R, 168.1 P, 173 R, 176.1 R, 160/177 R, 178.1 R, 236, 178.3
See application file for complete search history.

(56) References Cited

U.S. PATENT DOCUMENTS 2,130,319 A * 9/1938 Hammer ..... 160/178.3
2,130,320 A * 9/1938 Hammer ..... 160/178.3
2,152,117 A * 3/1939 Wade et al. ..... 160/177 R
2,716,448 A * 8/1955 Landess ..... 160/173 R
4,951,729 A * 8/1990 Chi Yu ..... 160/178.3
5,485,874 A * 1/1996 Whitmore ..... 160/115
5,582,226 A * 12/1996 Voss et al. ..... 160/168.1 R
5,918,657 A * 7/1999 Tuzmen ..... 160/168.1 R
6,179,035 B1 * 1/2001 Anderson ..... 160/168.1 R

* cited by examiner

*Primary Examiner*—Blair M. Johnson
(74) *Attorney, Agent, or Firm*—Ming Chow; Sinorica, LLC

(57) ABSTRACT

A blind includes a headrail, a bottomrail, a plurality of slats positioned between the headrail and the bottomrail, a plurality of ladders, a plurality of lift cords and a plurality of connectors. Each ladder is composed of two vertical portions and a plurality of rungs in parallel between the two vertical portions. The lift cords are positioned at two opposite sides of the slats and near the vertical portions of the ladders. Each slat has at least a hole near a longitudinal side edge, and a connector is deposited between the ladder and each slat. Then the connectors can combine the ladders and the lift cords with the slats in such a way that the slats can be kept from moving so as to shut off light effectively.

18 Claims, 9 Drawing Sheets

BLIND AND ITS ASSEMBLING METHOD

BACKGROUND OF THE INVENTION

1. Field of the Invention

This invention relates to a blind, particularly to one having an excellent efficiency and its assembling method.

2. The Prior Arts

Conventional blinds generally include a headrail, a bottomrail, a plurality of ladders and a plurality of lift cords combined between the headrail and the bottomrail, and a plurality of slats deposited in parallel between the headrail and the bottomrail. Each slat is provided with a plurality of holes properly spaced apart in the intermediate portion for the lift cords to pass through to lift up the bottomrail so that all the slats may be lifted up sequentially, and the ladders change the angle of every slat in various degrees so that the light may be adjusted in its strength to pass through every gap between every two slats into a room or totally shut out.

However, the conventional blinds have a common flaw that light may enter a room a little through the gap between every two adjacent slats even if the slats are adjusted in the completely closed condition. Moreover, the lift cords located in the intermediate portion of all the slats may interfere with the changeable angle of each slat and prevent two neighboring slats from closely contacting each other, resulting in a very small gap between every two neighboring slats for light to pass through in a room.

In order to shut out light with comparatively good effect, a U.S. Pat. No. 5,727,613 includes slats bored with no holes for lift cords but with a notch provided at two ends respectively, permitting every two neighboring slats to contact closely and vertically with each other when the blind is closed for shutting out light totally.

The blind disclosed in the U.S. Pat. No. 5,727,613 has the slats possible to move left and right, not restricted as such that the slats may slide out of one side of the blind if the blind is inclined to one side (whether right or left).

Further, U.S. Pat. No. 4,951,729, U.S. Pat. No. 5,386,867 and U.S. Pat. No. 6,792,996 have every slat bored with a hole near an end for a lift cord to pass through for preventing the slats from sliding out of a side of the blind. Besides, when the slats are turned in their angle to let every two neighboring slats to vertically contact with each other, the ends of each slat may hide the hole to reduce the volume of light passing there through, in addition to the function that the slats are prevented from sliding out of either side of the blind.

However, such blinds disclosed in the above three patents have the lift cords for moving up the slats and the bottomrail, and the lift cords generally have a big diameter, with the portion of the lift cords near the slats being not so flexible, so the lift cords pinched between two adjacent slats may hinder those two neighboring slats from closely contacting each other. Therefore, a small gap may result between every two neighboring slats, with the effect of the light prevention limited, and even a slender lift cord cannot completely get rid of this flaw, or support the whole weight of the all slats and the bottomrail owing to its weak strength, in addition to potential harm to a hand in pulling up the slats.

Further, a U.S. Pat. No. 5,582,226 discloses a blind provided with lift cords not passing through slats, but said slats still have a hole at two opposite sides and the ladders are twisted so that the slats may not turn smoothly. Moreover, after the bottomrail is lifted up for some distance, it may clearly interfere smooth turning of the slats.

Other two U.S. Pat. No. 6,729,379 and U.S. Pat. No. 6,854,504 acquired by the applicant of this invention include lift cords, and rings added on the lift cords for fitting around a bar located at two sides of slats, instead of the conventional lift cords. But this kind of lift cords can only apply to soft slats. As to a blind provided with rings and hard slats, as the structure disclosed in a U.S. Pat. No. 6,192,963, despite of the rings affixed on the ladders for the lift cord to pass through, there is still a problem of the slats sliding out of a side of the blind.

SUMMARY OF THE INVENTION

In order to solve the problems described above, the invention offers a slender rope for connecting each slat, each ladder and each lift cord for preventing the slats to slide out of one side of a blind, and thus beefing up effects of shutting out light completely.

The characteristics of the invention are slats, lift cords, ladders and connectors. The slats are horizontally positioned to space apart in parallel between the two vertical portions of the ladders and respectively on rungs of the ladders. The lift cords are respectively positioned at two opposite sides and near the ladders, Then each slat is provided with at least a hole in corresponding to each relative rung of the ladders, and each flexible connector passes through the hole of each slat and then combined with each lift cord and the vertical portion of each ladder so that the side edge of each slat can be prevented from moving laterally and excessively by mutual interaction with the lift cords or the ladders.

The method for a blind in the invention includes several steps of inserting a connector through the hole of each slat, of combining a first end of each connector with the vertical portion of each ladder, and of combining the second end of each connector with each lift cord. Thus the slats are prevented from sliding out of either side of the blind, and in addition, the holes of the slats may be hidden by the overlapped portions of every two adjacent slats in case the blind is handled to close up a gap between every two adjacent slats, whether the slats may be turned clockwise or counterclockwise.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
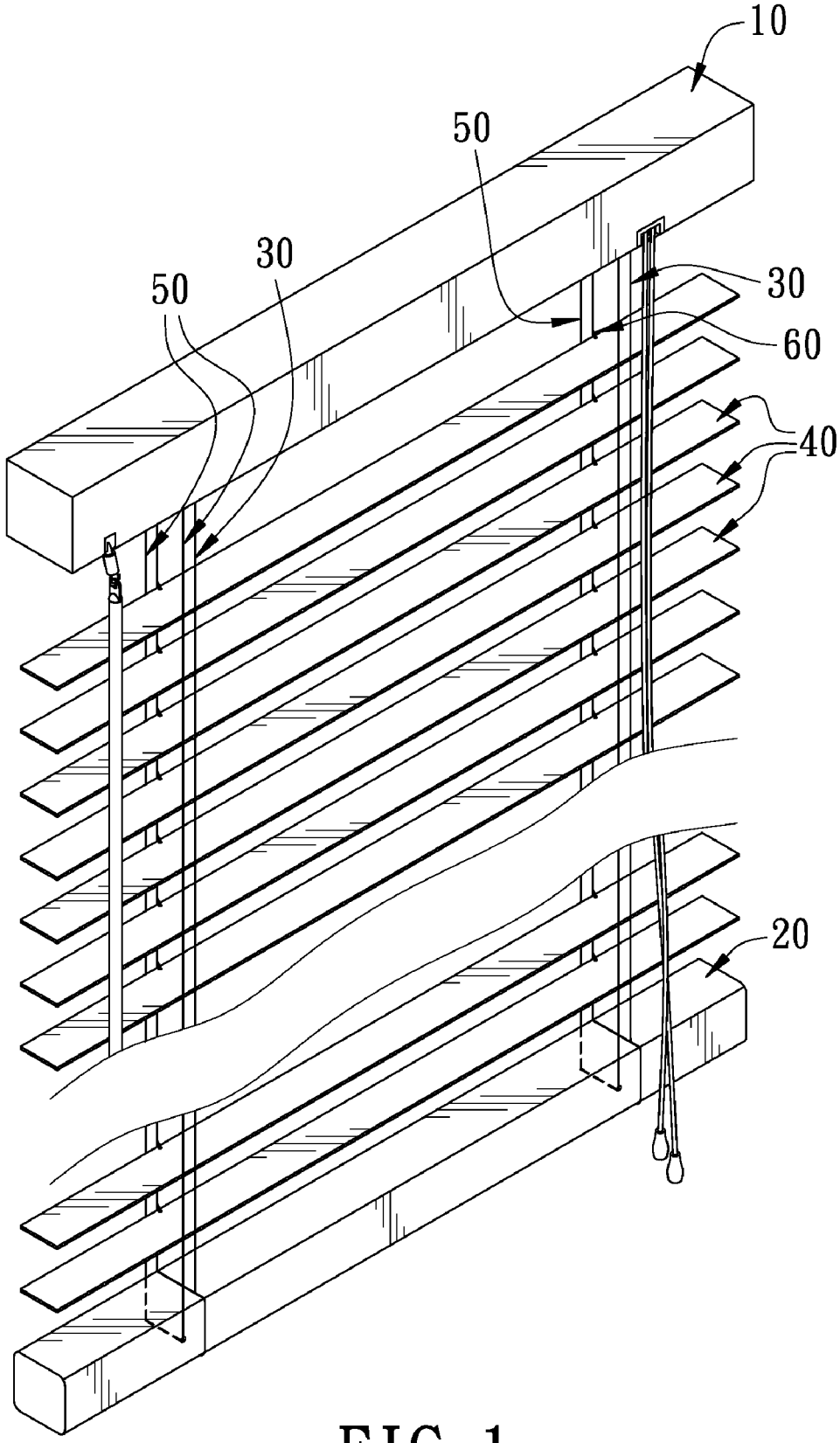
FIG. 1 is a perspective view of a first embodiment of a blind in the present invention.
Figure 2:
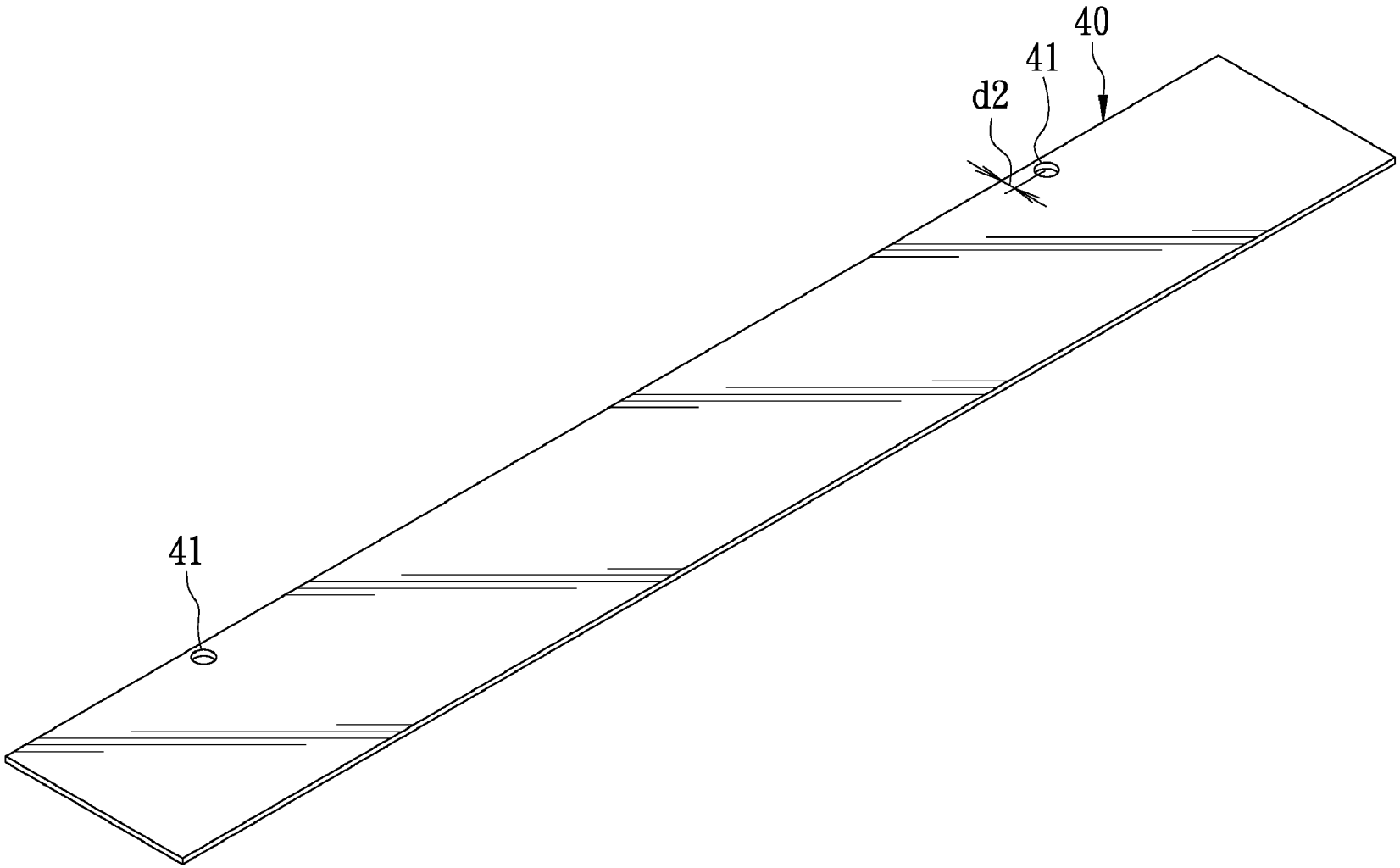
FIG. 2 is a perspective view of a slat in the first embodiment of a blind in the present invention.
Figure 3:
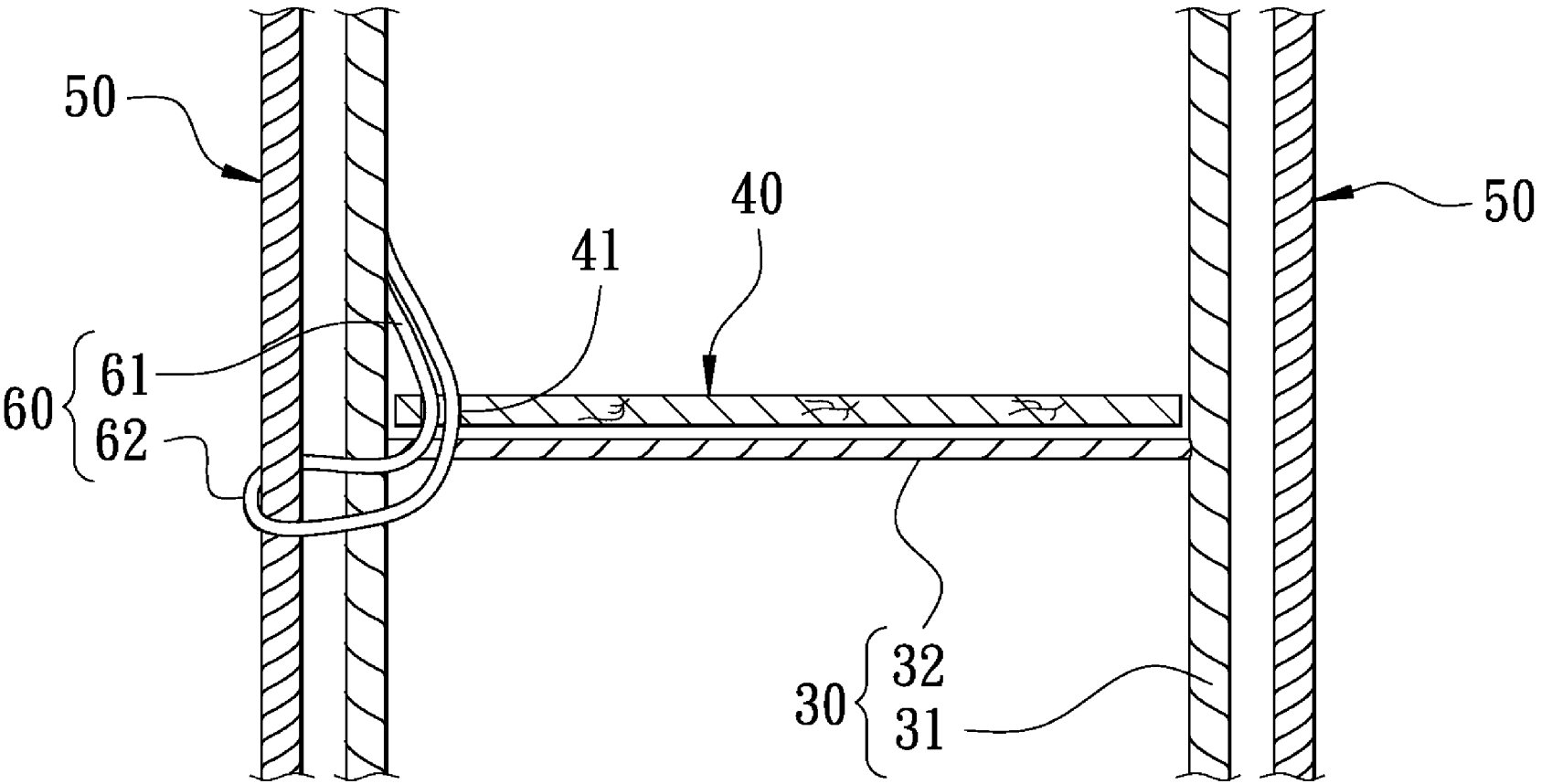
FIG. 3 is a partial cross-sectional view of the first embodiment of a blind in the present invention.

A first embodiment of a blind in the present invention, as shown in FIGS. 1-4, includes a headrail 10, a bottomrail 20, two ladders 30, a plurality of slats 40, two lift cords 50 and a plurality of connectors 60 as main components assembled together.

Figure 4:
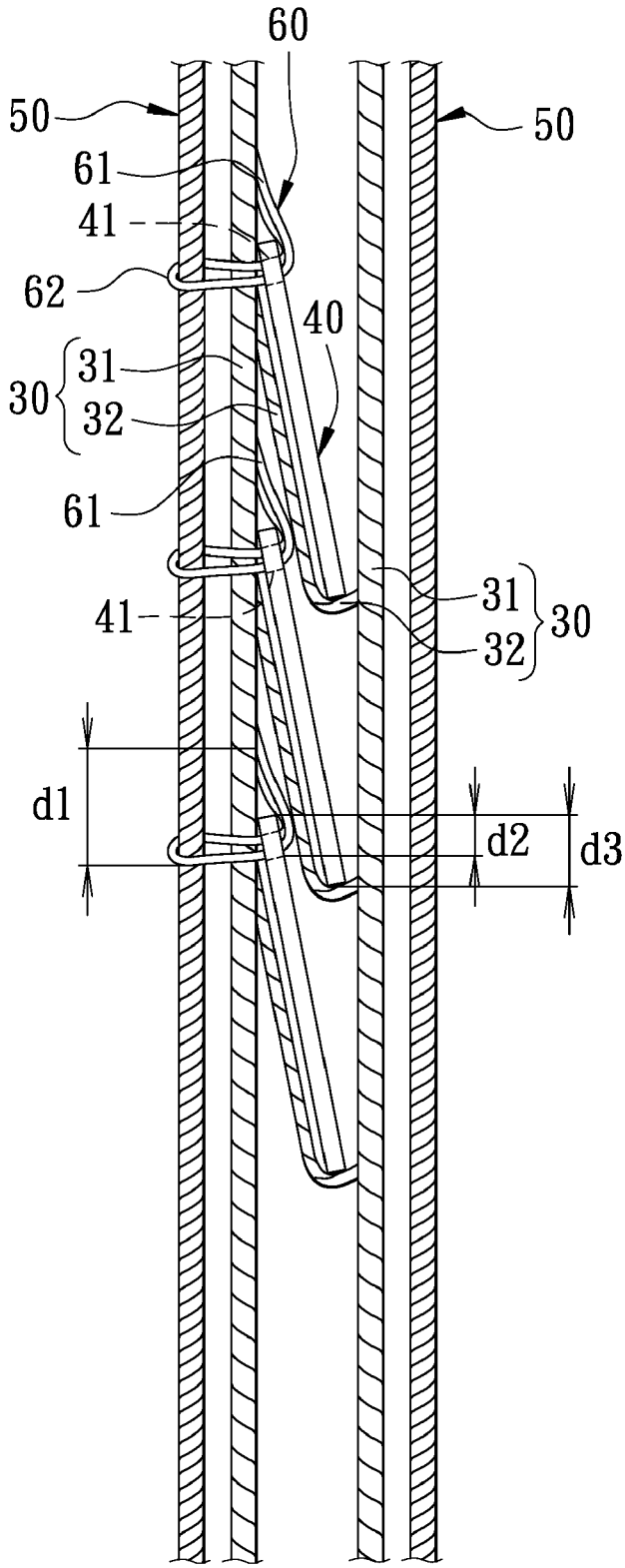
FIG. 4 is a partial cross-sectional view of the slats in the closed condition in the first embodiment of a blind in the present invention.

The two ladders 30 extend down in parallel from the headrail 10 to the bottomrail 20, positioned in a front portion of the blind, and respectively having two vertical portions 31 near the rear side of the blind and a plurality of rungs 32 connected and spaced apart equidistantly between the two vertical portions 31 The slats 40 are disposed horizontally below the headrail 10 and above the bottomrail 20 in the parallel condition and respectively lie nearly on the rungs 32 of the ladders 30. When a user moves up or down all or some of the vertical portions 31 of the ladders 30, the rungs 32 may be turned around to let the slats 40 to incline in an angle, limited by the rungs 32 in their slanting movement as shown in FIG. 4. Further, each slat 40 is bored with a hole 41 respectively near a rear longitudinal side edge and spaced apart.

The two lift cords 50 extend down in parallel from the headrail 10, having their lower end connected with the bottomrail 20.

The connectors 60 are very flexible, respectively having a first end 61 connected to the vertical portion 31 of the ladder 30 and distanced a little from the relative rung 2 and passing through the hole 41 of the relative slat 40, and a second end positioned under the relative slat 40 and then connected to a proper point of the lift cord 50. In this first embodiment the second end 62 is a looped end 62 for the lift cord 50 to pass through and move up and down therein.

Next, method for the blind in the invention includes following steps.

1. To bore the holes 41 in each slat 40 as mentioned above.
2. To place all slats 40 horizontally in equally parallel among the rungs 32 of the ladders 30, with the holes 41 located at the rear side of the blind.
3. To connect the connectors 60 on the vertical portions 31 of the ladders 30, and just on the relative hole 41 of the slats 40, with the first end 61 of each connector 60 fixed on the relative vertical portion 31, and with the second end 62 passing through the relative hole 41 and extending to under the slat 40.
4. To insert the lift cord 50 through the second looped end 62 of the connectors 60, letting the second looped end 62 restrict lateral movement of the lift cord 50.

In this way, each connector 60 located between the ladder 30 and the hole 41 of each slat 40 can block each slat 40 from sliding out of the blind. Such a design of the looped ends 62 of the connectors 60 can permit up-and-down movement of the lift cords 50 but inhibit their right-and-left movement.

As described above, the holes 41 of the slats 40 planned in the invention is located near the longitudinal side edge, and in addition, the distance (d2) between each hole 41 and the longitudinal side edge is shorter than the width (d3) of the overlapped portions of the two vertically adjacent slats 40, so when all the slats 40 are turned to shut completely, each hole 41 can be hidden by the relative overlapped portions of the two adjacent slats 40, which can effectively shut off light from passing through the blind.

Moreover, the distance (d1) between the first end 61 of each connector 60 and the relative rung 32 of the ladder 30 is longer than the distance (d2) between the hole 41 and the longitudinal side edge of the slat 40 so that each connector 60 and the ladder 30 can freely move relatively, permitting all the slats 40 move smoothly without any hitch.

Besides, a manufacturer can select properly slender cotton cords or plastic cords for the connectors 60, so every two adjacent slats can be positioned nearer to overlap so that the gap between every two adjacent slats may be lessened as possible in case of closing the blind.

Next, though the connectors 60 and the lift cords 50 are positioned in the rear portion of the blind in the preferred embodiment, the end of each connector 60 is also possible to be combined with the lift cord 50 (not shown in figures) in the front portion of the blind, as an equal art.

Figure 5:
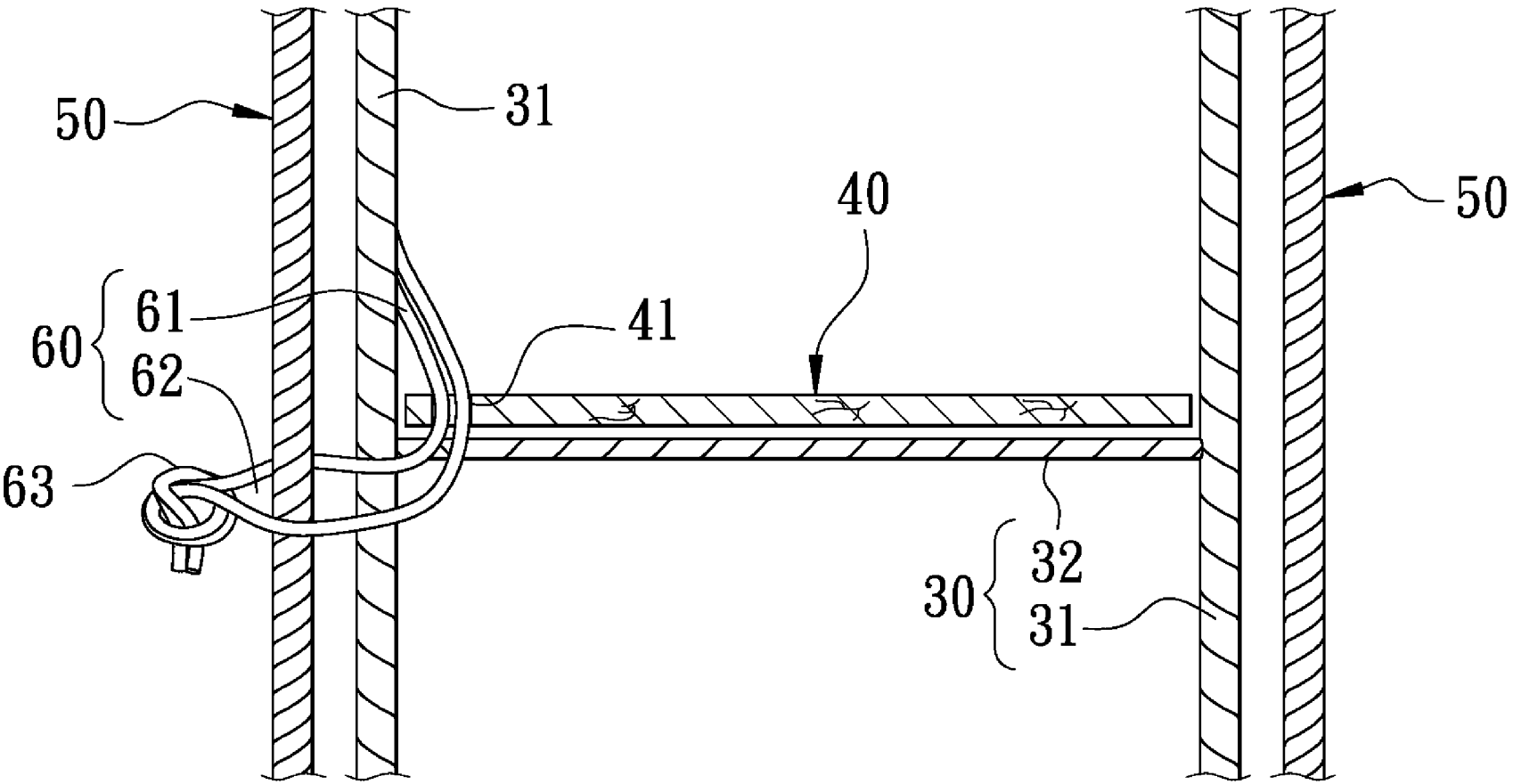
FIG. 5 is a partial cross-sectional view of a second embodiment of a blind in the present invention.

FIG. 5 shows a second embodiment of a blind in the invention, which has almost the same structure as the first one, except that the connectors 60 are respectively composed of two ropes, passing through the holes 41 and having the second end forming a knot 63 so that the lift cord 50 can pass though between the two ropes.

As for the connecting way of the first end 61 of each connector 60 and the ladder 30, a weaving way or mechanical sawing can directly be used or any way fastening the both together can be employed, as an equal art. In addition, ears added to the longitudinal side edge of each slat 40 can be used in place of the holes 41.

Figure 6:
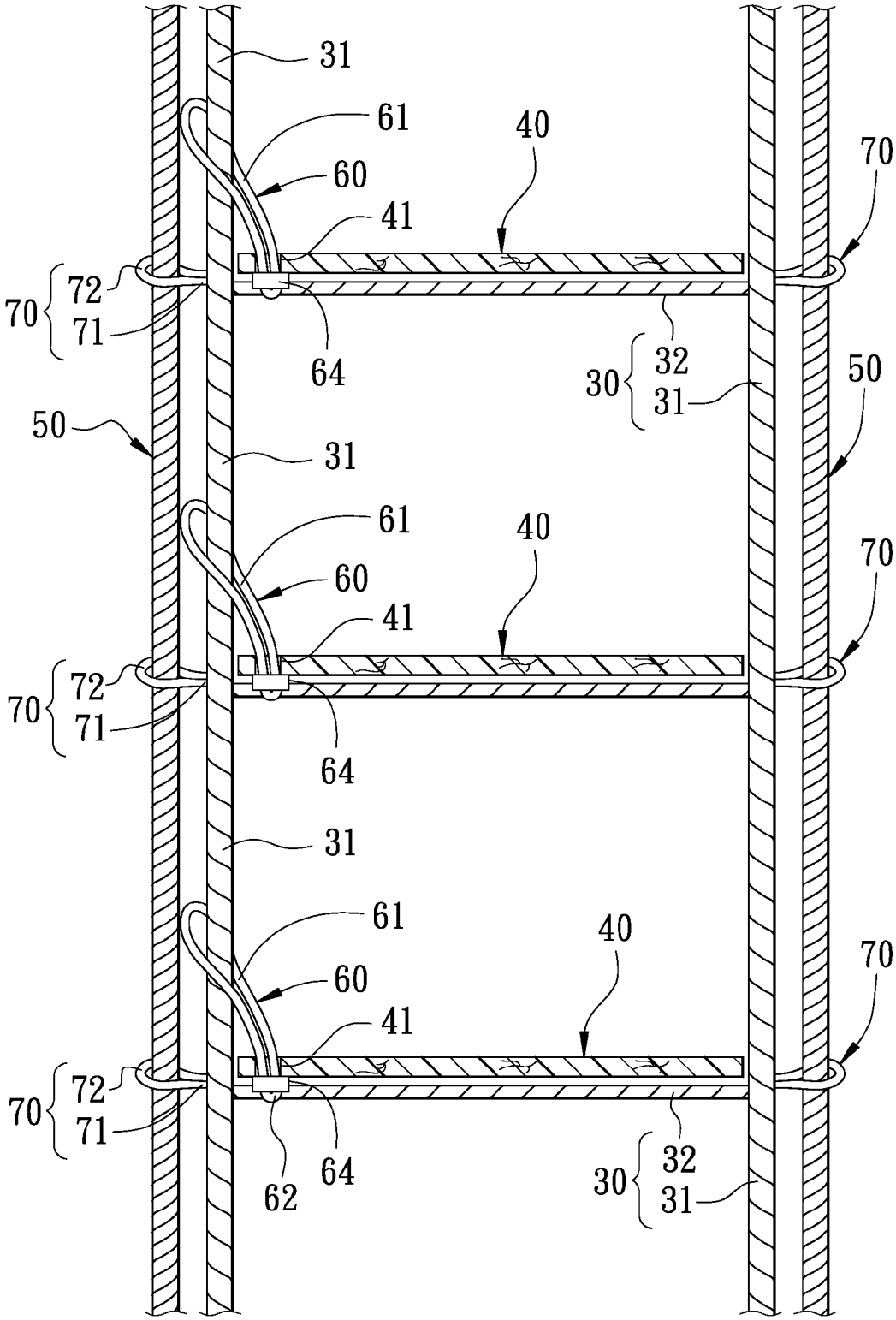
FIG. 6 is a partial cross-sectional view of a third embodiment of a blind in the present invention.

Next, FIG. 6 shows a third embodiment of a blind in the invention, which has almost the same structure, except that the second end 62 of each connector 60 is added with a metal element 64 having an outer diameter larger than the inner diameter of the hole 41 to let each slat 40 stop the metal element 64 and the connector 60 together. Therefore the second end 62 is unable to slide out of the slat 40.

Instead of the stopper 64 fixed on the second end 62 of the connector 60, a loop or a knot shown in FIG. 5 also can be used for hampering the connector 60 from loosening off.

Moreover, a plurality of sleeving members 70 can further be affixed on the ladders 30, and its number can be more or less than that of the rungs 32 of the ladders 30. The sleeving members 70 can be located at the front end and the rear end of each rung 32 or only the rear end of each rung 32. An inner end 71 of each sleeving member 70 is connected with the vertical portion 31 and an outer looped end 72 is for the lift cord 50 to pass through. Thus, the ladders 30 are connected to each slat 40 by means of the connector 60 and the ladder 30 is combined with the lift cord 50 by means of the sleeving member 70 so that the ladder 30, the connector 60 and the lift cord 50 can keep the slat 40 from sliding out of the blind and the lift cord 50 from moving laterally.

Figure 7:
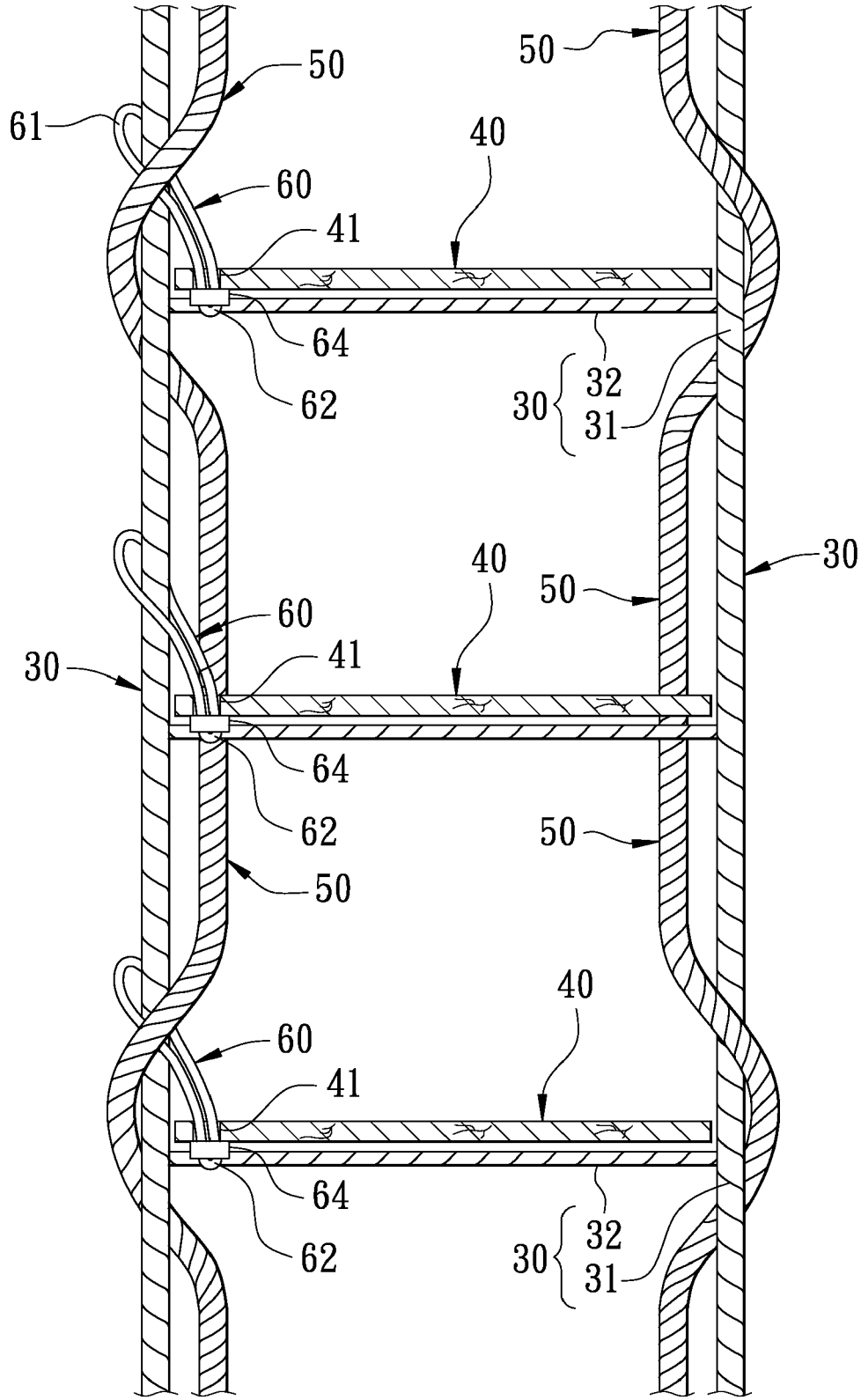
FIG. 7 is a partial cross-sectional view of a fourth embodiment of blind in the present invention.

Next, FIG. 7 shows a fourth embodiment of a blind in the invention, which has almost the same structure as the first one, except that each ladder 30 is connected with each slat 40 on each rung 32 of the ladder 30 by means of the connectors 60 in the same way illustrated in FIG. 6. But each lift cord 50 intertwines intermittently around the vertical portion 31 of each ladder 30 and also passing through a space between every two adjacent rungs 32 from the headrail 10 vertically down to the bottomrail 20, combining effectively each ladder 30 with each lift cord 50.

Figure 8:
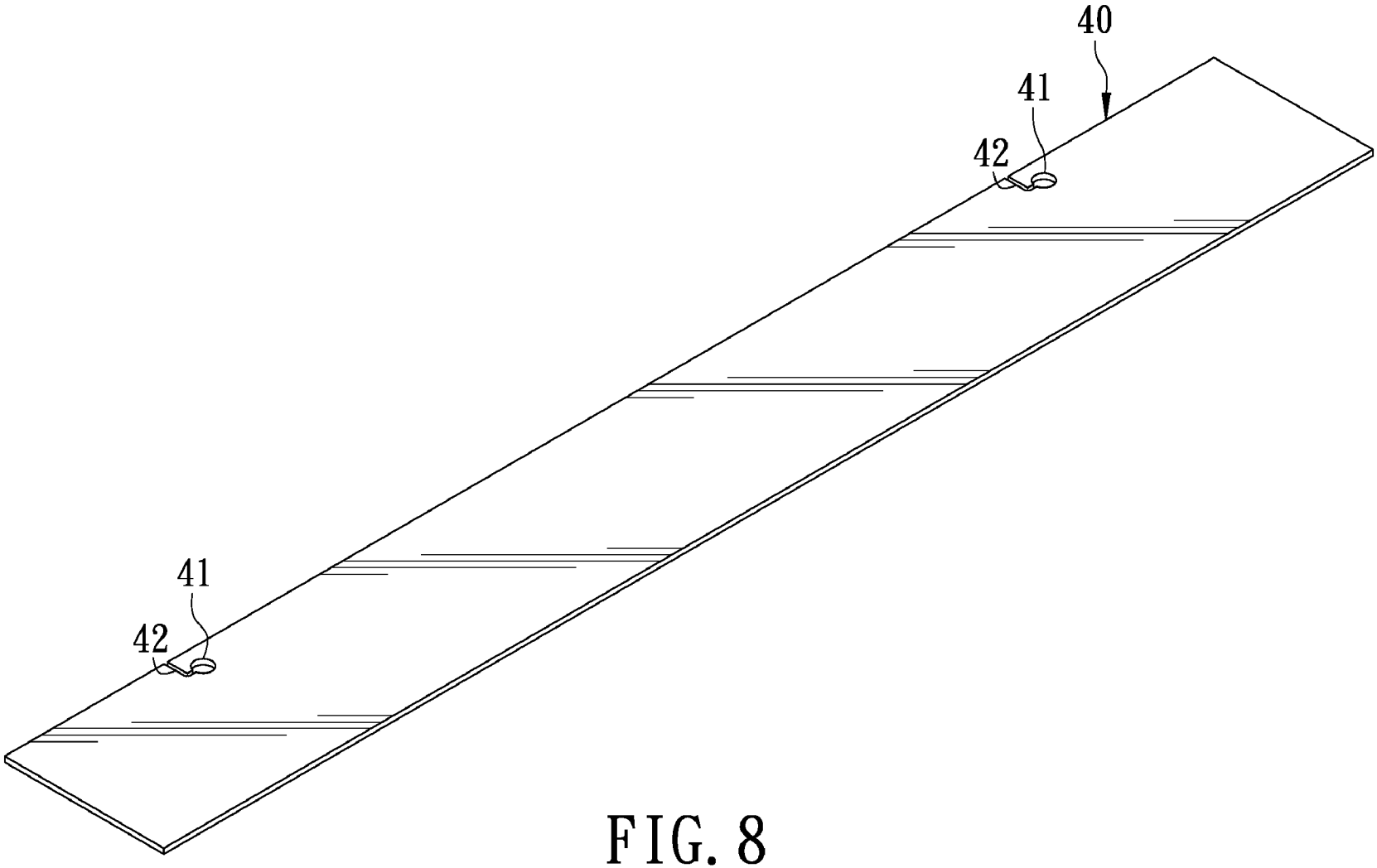
FIG. 8 is a perspective view of a slat in a fifth embodiment of a blind in the present invention; and, FIG. 9 is a partial cross-sectional view of a sixth embodiment of a blind in the present invention.

Next, FIG. 8 shows a second style of slats 40 usable in all the preferred embodiments of a blind described above, which is provided with two same holes 41 as that in the above-mentioned embodiments, and a slender groove 42 additionally connected to each hole 41 and opening out of the longitudinal side edge of each slat 40. Then the slender grooves 42 are helpful for the slat 40 to be combined with the ladder 30.

Figure 9:
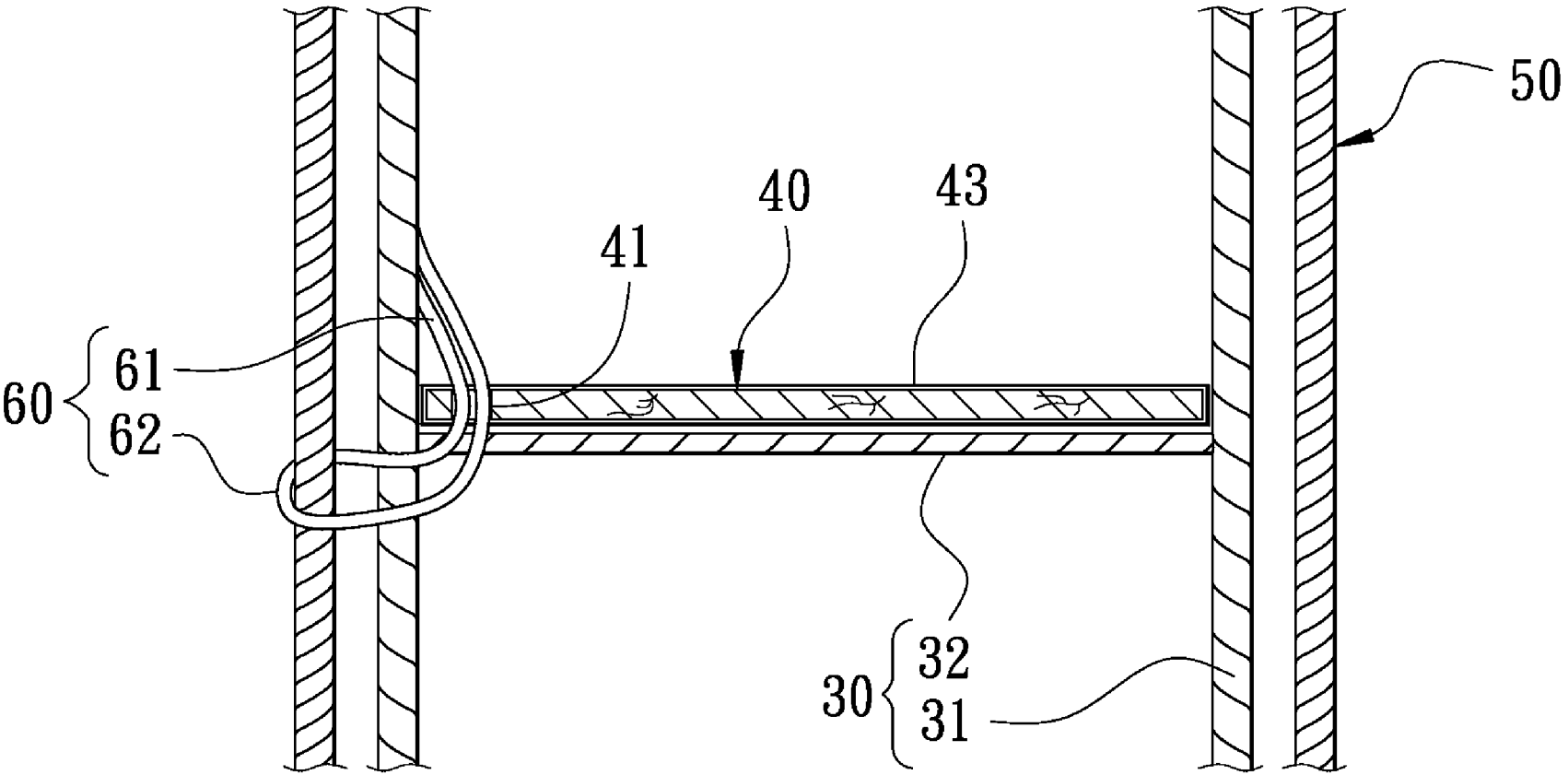

FIG. 9 shows a third style of slats 40 usable in all the preferred embodiments of a blind in the invention, which is added with a surrounding cover 43 around each original slat 40 as that used in the first embodiment of a blind, giving an alter to its appearance. The cover 43 may be a cloth or a coated layer of paint, possible to permit the flexible connector 60 to pass through the cover 43 and the hole 41.

The invention has the following advantages, as can be understood from the foresaid description.

1. The slats, the ladders and the lift cords interact mutually so that they are limited in right-and-left movement, impossible to slide off or shift too much, because of the provision of the holes of each slat.
2. The holes of the slats can be hidden by the overlapped portions of the side edges of the adjacent slats in case of the blind completely closed, not exposed out of the blind to worsen its appearance and its seclusion, because the holes of each slat are located at two opposite side edges.
3. The lift cords and the ladders give enough space for each slat to turn easily so that each slat can turn clockwise or counterclockwise to a complete close to obtain good effect of shutting out light, because there is a proper distance between the first end of each connector and each rung of the ladder in addition to the flexibility of the connectors.

While the preferred embodiments of the invention have been described above, it will be recognized that various modifications may be made therein and the appended claims are intended to cover all such modifications that may fall into the spirit and scope of the invention.

What is claimed is:

1. A blind comprising:

a headrail;

a bottomrail provided below said headrail;

at least two ladders extending in parallel from said headrail to said bottomrail, each said ladder composed of one front vertical portion and one rear vertical portion and a plurality of rungs spaced apart equidistantly and between said two vertical portions;

a plurality of slats disposed horizontally between said headrail and said bottomrail and sequentially and respectively laid on said rungs of said ladders, said slats having at least one hole near a longitudinal side edge;

a plurality of lift cords in parallel extending from said headrail and connected to said bottomrail; and, a plurality of connectors with proper flexibility respectively having a first end connected to a preset point of each said ladder, an intermediate passing through said hole respected to one of said slats, and a second end slidably connected to one of said lift cords.

2. The blind as claimed in claim 1, wherein the number of said connectors is at least the same as that of said slats, and having a proper distance between said first end connected to each said ladder and each said rung of each said ladder.

3. The blind as claimed in claim 1, wherein each said first end of each said connector connected to each said ladder is located above each said slat and each said rung of each said ladder.

4. The blind as claimed in claim 1, wherein a minimum distance between each said hole and said longitudinal side edge is shorter than a width overlapped respectively by a front and a rear side edges of two slats in a closed state of said blind.

5. The blind as claimed in claim 1, wherein said second end of each said connector is formed as a loop for each said lift cord to pass through.

6. The blind as claimed in claim 1, wherein at least one of said connectors is composed of two ropes, the end of said ropes in a tying way formed said looped second end.

7. The blind as claimed in claim 1, wherein said vertical portion of said ladders at a rear side of said blind is connected to said first end of each said connector, and said second end connected to said lift cord is at a rear side of said blind.

8. The blind as claimed in claim 1, wherein said vertical portion of said ladders at the rear side of said blind is connected to said first end of each said connector, and said second end connected to said lift cord is at a front side of said blind.

9. The blind as claimed in claim 1, wherein each said slat has at least one groove extended from each said hole to said longitudinal side edge of said slat.

10. A blind comprising:

a headrail;

a bottomrail positioned below said headrail;

at least two ladders extending in parallel from said headrail down to said bottomrail, each said ladder having a front vertical portion, a rear vertical portion, and a plurality of rungs spaced apart equidistantly between said two vertical portions;

a plurality of slats positioned between said headrail and said bottomrail and sequentially spaced apart equidistantly and horizontally among said rungs of said ladders, each said slat having at least a hole near a longitudinal side edge;

a plurality of lift cords extending in parallel from said headrail and connected to said bottomrail with a lower end of said lift cords; and, a plurality of connectors with proper flexibility respectively having a first end of each connector connected to a proper point of said ladder, an intermediate portion of each said connector passing through and located in said hole of each said slat, and a second end of each said connector provided with a stopper at an opposite side of said first end for preventing said connector from slipping off said slats.

11. The blind as claimed in claim 10, wherein said stopper is a metal element clamped said second end.

12. The blind as claimed in claim 10, further comprising a plurality of sleeving members one end connected to said ladder, and the other end connected to at least one of said lift cords such that said lift cord slides up and down.

13. The blind as claimed in claim 10, wherein one part of each said lift cord set at a left side of at least one rung, and at a right side of the other said rungs.

14. A method for assembling a blind, said blind comprising:

a headrail;

a bottomrail positioned below said headrail;

at least two ladders extending in parallel from said headrail down to said bottomrail, each said ladder composed of a front vertical portion, a rear vertical portion and a plurality of rungs spaced apart equidistantly between said two vertical portions;

a plurality of slats horizontally positioned spaced apart equidistantly between said headrail and said bottomrail and respectively located on said rungs;

a plurality of lift cords extending in parallel from said headrail down and connected to a lower end of said bottomrail; and, said method comprising:

1. Providing a hole near a longitudinal side edge of each said slat in corresponding to said ladder;

2. Placing a plurality of flexible connectors respectively adjacent to said rungs, with a first end of each said connector connected to said ladder; and,
3. Passing an intermediate portion of each said connector through said hole of said slats, extending a second end of each said connector to the other side of each said slat opposite to said first end and forming a stopper to prevent said second end from moving to said first end.

15. The method for assembling a blind as claimed in claim 14, wherein said vertical portion of said ladder at a rear side of said blind is connected to said first end of each said connector, and said lift cord connected to said second end is located at a rear side of said blind.

16. The method of assembling a blind as claimed in claim 14, wherein said vertical portion of said ladder at the rear side of said blind is connected to said first end of each connector, and said lift cord connected with said second end of each said connector is located at a front side of said blind.

17. The method for assembling a blind as claimed in claim 14, wherein said second end of each said connector has an outer diameter larger than the inner diameter of said holes of each slat for forming said stopper.

18. The method for assembling a blind as claimed in claim 14, wherein, in said second step, said first end of each said connector is fixed with said vertical portion of said ladder and located above each said slat, and said second end passing through said hole of said slat, extending to a downside of each said slat, and forming a stopper near said holes.

* * * * *